US006447274B1

(12) United States Patent
Horihata et al.

(10) Patent No.: US 6,447,274 B1
(45) Date of Patent: Sep. 10, 2002

(54) ROTARY COMPRESSOR HAVING A CYLINDER BLOCK OF SINTERED METAL

(75) Inventors: Hideyuki Horihata; Hiraku Shiizaki; Shigeru Muramatsu; Hirotsugu Fukuoka, all of Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/706,393

(22) Filed: Nov. 3, 2000

(51) Int. Cl.[7] ..... F04C 18/356; F04C 23/00

(52) U.S. Cl. ..... 418/60; 418/63; 418/179; 418/29; 418/888.025

(58) Field of Search ..... 418/60, 63, 179; 29/888.025

(56) References Cited

U.S. PATENT DOCUMENTS 5,102,317 A * 4/1992 Okoma et al. ..... 418/60
6,290,472 B2 * 9/2001 Gannaway ..... 418/60

FOREIGN PATENT DOCUMENTS

JP 60-135687 * 7/1985 ..... 418/60
JP 4-159486 * 6/1992 ..... 418/179
JP 6-147168 * 5/1994 ..... 418/179

* cited by examiner

*Primary Examiner*—John J. Vrablik
(74) *Attorney, Agent, or Firm*—RatnerPrestia

(57) ABSTRACT

A rotary compressor of the present invention includes a compression mechanism, motor and hermetically sealed housing. The compression mechanism includes compression elements, a rotary shaft and bearing. The compression elements includes a cylinder block, piston, and vane. The cylinder block has a cylinder hole and vane groove. The compression mechanism and the motor are housed in the hermetically sealed housing. The cylinder block is made up of sintered metal. The compression mechanism is welded to the hermetically sealed housing in a region other than the cylinder block. Preferably, the cylinder block includes a first cylinder block and a second cylinder block, and the first cylinder block and the second cylinder block are formed by machining sinter-molded blanks identical in shape. With this configuration, it is possible to reduce the machining processes and to make the blank parts usable in common, thereby realizing a low-cost compressor.

22 Claims, 10 Drawing Sheets

ROTARY COMPRESSOR HAVING A CYLINDER BLOCK OF SINTERED METAL

FIELD OF THE INVENTION

The present invention relates to a rotary compressor, particularly the structure of its cylinder block.

BACKGROUND OF THE INVENTION

FIG. 11 is a conventional rotary compressor. A rotary-type compression mechanism 102 is housed in a hermetically sealed housing 101. The rotary-type compression mechanism 102 comprises cylinder block 103*a*, 103*b*, piston 104*a*, 104*b*, vane, rotary shaft 105, main bearing 107, and sub-bearing 108. The piston 104*a*, 104*b* eccentrically rotates in the cylinder. The vane moves reciprocally with its end being in contact with the end of piston 104*a*, 104*b*, dividing the cylinder into a high-pressure chamber and a low pressure chamber. The rotary shaft 105 drives the piston 104*a*, 104*b*. The main bearing 107 and sub-bearing 108 hold the axial end of cylinder block 103*a*, 103*b* therebetween, rotatably supporting the rotary shaft 105, and the main bearing 107 is positioned at motor 106 side and, the sub-bearing 108, at the opposite side of the motor. In the example of this conventional type, there are provided upper and lower compression elements, and the two compression elements are arranged with an intermediate plate 109 therebetween. The cylinder block 103*a*, 103*b* is made of cast iron. The compression mechanism 102 is secured to the hermetically sealed housing with the cylinder block 103*a* spot-welded thereto.

However, in such conventional rotary compressor, many processes such as making a number of holes and taps by machining cast iron and surface finishing are necessary to make cylinder blocks, resulting in higher costs. Particularly, in a two-cylinder rotary compressor, it is necessary to make two-cylinders, and in addition, the upper and lower cylinders are different in shape, adding to the cost of making cylinder blocks.

The present invention is intended to provide a compressor which is inexpensive and less in machining processes.

SUMMARY OF THE INVENTION

A rotary compressor of the present invention comprises a compression mechanism, a motor, and a hermetically sealed housing. The compression mechanism includes compression elements, a rotary shaft and bearing. The compression elements include a cylinder block, piston and vane. The cylinder block includes a cylinder hole and vane groove. The bearing closes the end of the cylinder hole and bears the rotary shaft. The compression mechanism and the motor are housed in the hermetically sealed housing. The cylinder block is made up of sintered metal. The compression mechanism is welded to the hermetically sealed housing within the region other than the cylinder block.

The method for manufacturing a rotary compressor of the present invention comprises the steps of:

(a) forming a sinter-molded blank for cylinder blocks by using sintered metal, and (b) securing a compression mechanism to a hermetically sealed housing by welding the compression mechanism to the hermetically sealed housing in a region other than the cylinder block.

Preferably, the sintered metal is sintered iron.

Preferably, the cylinder block includes a first cylinder block and a second cylinder block, and the first cylinder block and the second cylinder block are formed by machining sinter-molded blanks identical in shape.

By this configuration, it is possible to reduce the machining processes and to make the blank parts usable in common, realizing the manufacture of a low-cost compressor. Further, the two cylinder blocks, the first cylinder block and the second cylinder block, may be die-formed by sinter molding, and it is possible to make the sinter-molded blanks identical in shape. Accordingly, it is possible to reduce the machining processes and to make the blank parts usable in common, thereby realizing the manufacture of a low-cost compressor.

DETAILED DESCRIPTION OF THE INVENTION

Figure 1:
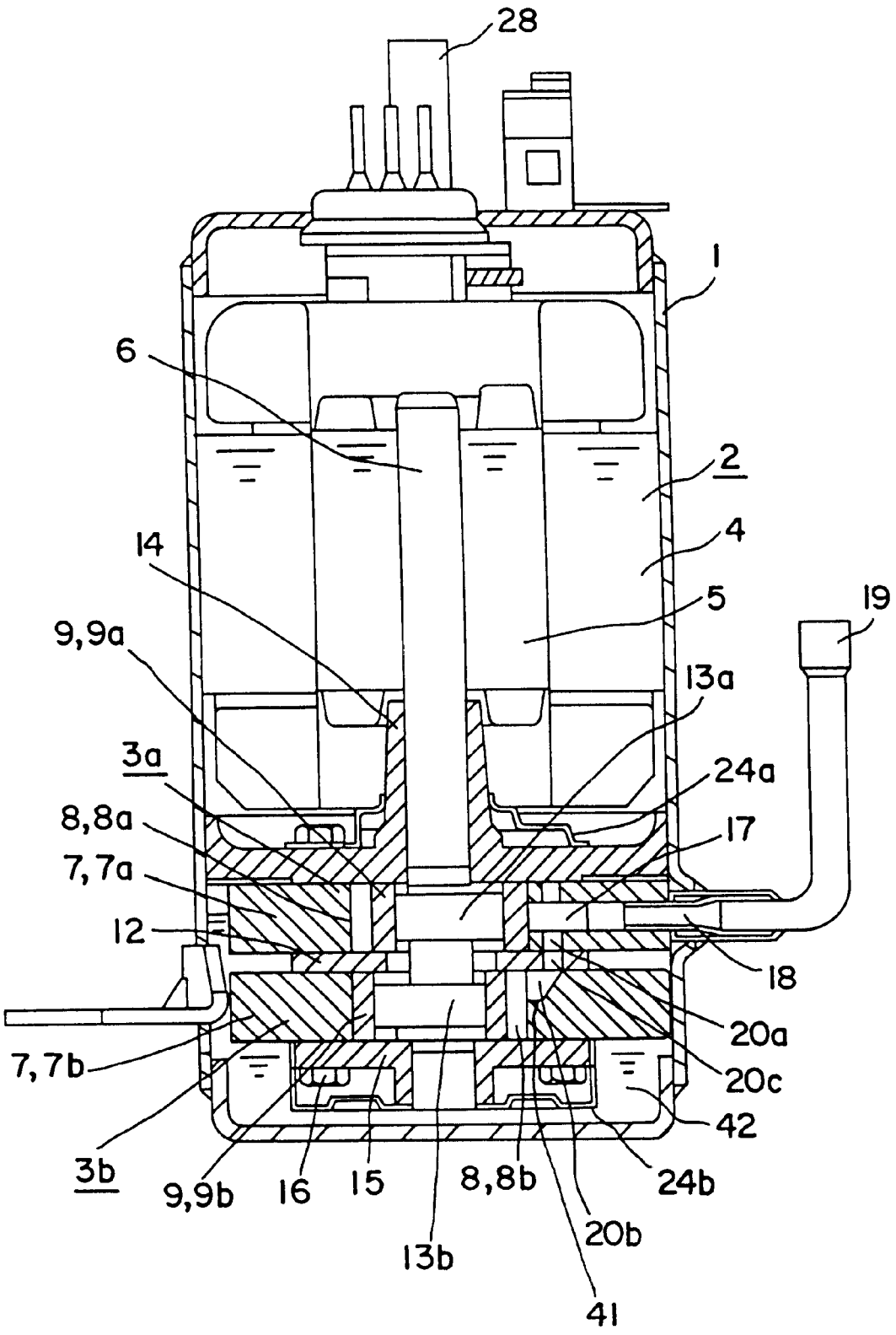
FIG. 1 is a longitudinal sectional view of a two-cylinder rotary type compressor, showing the entire configuration of the embodiment of the present invention.

A rotary compressor of an embodiment of the present invention comprises a compression mechanism, motor and hermetically sealed housing. The compression mechanism includes compression elements, rotary shaft, main bearing and sub-bearing. The compression elements include a cylinder block, piston and vane. The cylinder block includes a cylinder hole and a vane groove diametrically connected thereto. The piston eccentrically rotates in the cylinder hole. The vane moves reciprocally in the vane groove while being in contact with the piston. The rotary shaft has an eccentric portion to drive the piston with the phase shifted by 180 degrees. The main bearing and sub-bearing serve to close the end of cylinder hole and to bear the rotary shaft. Both of the compression mechanism and the motor are housed in the hermetically sealed housing. The cylinder block is made up of sintered iron. The compression mechanism is welded to the hermetically sealed housing in a region other than the cylinder block. By virtue of this configuration, two cylinder blocks may be molded by sintering and it is possible to make the sinter-molded blanks identical in shape with each other. Accordingly, it is possible to reduce the machining processes and to make the blank parts usable in common, thereby realizing the manufacture of a low-cost compressor.

The method for manufacturing a rotary compressor of an embodiment of the present invention comprises processes such as:

(a) a process of forming a sinter-molded blank for cylinder blocks by using sintered metal, and (b) a process of securing a compression mechanism to a hermetically sealed housing by welding the compression mechanism to the hermetically sealed housing in a region other than the cylinder block.

Preferably, the rotary compressor further comprises an intermediate plate. The cylinder block includes a first cylinder block and a second cylinder block. The intermediate plate is disposed between the first cylinder block and the second cylinder block. The first cylinder block and the second cylinder block include sinter-molded blanks identical in shape. Due to this configuration, there is no need of providing two kinds of dies and it is possible to make the molded blanks usable in common, realizing the cost reduction.

Preferably in particular, the sinter-molded blank for cylinder blocks includes a molded cylinder hole and vane groove. With this configuration, the molded blanks are usable in common and there is no need of preparing two kinds of dies, thereby lessening the machining processes and reducing the cost.

Preferably in particular, the sinter-molded blank for cylinder blocks is provided with mounting holes formed therein. Due to this configuration, the molded blanks are usable in common, and there is no need of preparing two kinds of dies, thereby lessening the machining processes and reducing the cost.

Preferably in particular, the sinter-molded blank for cylinder blocks includes an intake passage formed therein. With this configuration, the molded blanks are usable in common, and there is no need of preparing two kinds of dies, thereby lessening the machining processes and reducing the cost.

Preferably in particular, the intake passage of the sinter-molded blank for cylinder blocks includes a through-hole in axially parallel with the cylinder hole, a connecting passage leading to the through-hole and opening to the cylinder hole, and an opening made at the position of the vane groove side in relation to the through-hole center, and the opening is less in width than the diameter of the through-hole. Due to this configuration, it is possible to form the sinter-moldered blank by using a sintering die. Further, the intake passage has an adequate space, and the opening is positioned at the vane side, thereby improving the volume efficiency.

Preferably in particular, the compression mechanism includes an intake port, and the intake port takes in refrigerant gas from outside the closed container. The intake port is provided at the main bearing, intermediate plate or sub-bearing. Due to this configuration, it is possible to make the intake passages of two cylinder blocks identical in shape and to make the cylinder blocks usable in common.

Preferably in particular, the first cylinder block and the second cylinder block are identical in shape. With this configuration, the molded blanks are usable in common and there is no need of preparing two kinds of dies, thereby reducing the cost.

Preferably in particular, at least one of the first cylinder block and the second cylinder block comprises an intake port to take in refrigerant gas from outside the hermetically sealed housing. By virtue of this configuration, after-machining of the intake port makes the molded blanks usable in common.

Preferably in particular, the intake port has a through-hole in a direction diametrical to the cylinder hole, and the intake hole is a machined hole created in the sinter-molded blank for cylinder blocks by machining from outside the cylinder block. With this configuration, the molded blanks are usable in common.

Preferably in particular, the intake port is formed in the sinter-molded blank for cylinder blocks, and the intake port is a machined hole formed by machining. The intake hole is connected to the through-hole of the intake passage from outside the cylinder block, and is not connected to the cylinder hole. Due to this configuration, the sinter-molded blank for cylinder blocks may be manufactured by using a sintering die, and the molded blanks are usable in common. Further, the passage space obtained is sufficient and the opening is positioned at the vane side, resulting in volume efficiency improvement.

Preferably in particular, the compression mechanism comprises a discharge port to discharge the compressed refrigerant, and the discharge port is formed in each of the main bearing and sub-bearing. Each discharge port is a machined hole formed by machining. The discharge port is located inside and outside the cylinder hole as viewed axially, and the cylinder block located just outside the discharge port is provided with a slanted notch. With this configuration, although the discharge directions in the upper and lower cylinders differ from each other, the parts may be formed by machining. Accordingly, the molded blanks become usable in common. Further, the passage space obtained is sufficient and the opening is positioned at the vane side, resulting in volume efficiency improvement.

Preferably in particular, the compression mechanism is welded to the main bearing, intermediate plate or sub-bearing. Due to this configuration, the cylinder block may be made up of sintered iron.

Preferably in particular, one of the first cylinder block and the second cylinder block comprises an intake port, and the intake port has a through-hole that goes through in a direction diametrical to the cylinder hole. The intake port is made by machining from outside the cylinder block, and the through-hole is axially formed so as to be intersected by the intake port. The intermediate plate is provided with a connecting hole that leads to the through-hole, and the intake port has a slanted notch. The notch is connected to the intake port of the other cylinder block via the connecting hole. That is, the passage from one cylinder to the other cylinder is a through-hole in an axial direction. Due to this configuration, it is possible to manufacture the cylinder blocks by using a sintering die, reducing the machining processes and the cost.

Preferably in particular, one of the first cylinder block and the second cylinder block comprises an intake port, and the slanted notch is connected to the intake port of the other cylinder block via the connecting hole. The slanted notch is formed in the range of ⅓ to ⅔ of the axial length of the cylinder block. With this configuration, it is possible to secure a suitable intake passage space and to obtain a high-efficiency compressor.

Preferably in particular, the slanted notch is connected to the intake port of the other cylinder block via the connecting hole, and the intersection between the slanted notch and cylinder hole is in the range of 75 to 90 degrees. With this configuration, it is possible to secure a holding area in powder molding press operation and to make the notch shape by using a sintering die, thereby reducing the machining processes and the cost.

The compressor of another embodiment of the present invention comprises a compression mechanism, motor, hermetically sealed housing, intermediate plate, and small chamber. The compression mechanism includes compression elements, rotary shaft, main bearing and sub-bearing. The compression elements include a cylinder block, piston and vane. The cylinder block includes a cylinder hole and a vane groove diametrically connected thereto. The piston eccentrically rotates in the cylinder. The vane moves reciprocally in the vane groove while being in contact with the piston. The rotary shaft has an eccentric portion to drive the piston with the phase shifted by 180 degrees. The main bearing and sub-bearing serve to close the end of cylinder hole and to bear the rotary shaft. Both of the compression mechanism and the motor are housed in the closed container. The cylinder block is made up of sintered iron. The compression mechanism is welded to the hermetically sealed housing in a region other than the cylinder block. The cylinder block comprises a first cylinder block and a second cylinder block. The intermediate plate is disposed between the first cylinder block and the second cylinder block. The cylinder block has a narrow passage at the axial end of cylinder block. The small chamber is connected to the axial end of the cylinder block by a narrow passage near the discharge port located at the main bearing or sub-bearing. The small chamber is formed between the ends of main bearing or sub-bearing. By virtue of this configuration, the pressure pulsation generated in the cylinder due to the resonant effect caused by the small chamber and passage will be reduced to decrease the noise, and as a result, a low-noise compressor may be obtained.

Preferably in particular, the small chamber formed at the axial end of cylinder block in the form of sinter-molded blank is connected by a narrow passage to a point near the discharge port. With this configuration, it is possible to mold and manufacture a resonant chamber (small chamber) by using a sintering die, thereby reducing the machining processes and the cost.

Preferably in particular, the small chamber and narrow passage formed at the axial end of cylinder block in the form of sinter-molded blank are connected by the narrow passage to a point near the discharge port. With this configuration, it is possible to mold and manufacture a resonant chamber (small chamber and passage) by using a sintering die, thereby reducing the machining processes and the cost.

Preferably in particular, the small chamber and narrow passage formed at the axial end of cylinder in the form of sinter-molded blank are connected by the narrow passage to the discharge notch provided in the cylinder block. With this configuration, it is possible to mold and manufacture a resonant chamber (small chamber and passage) by using a sintering die, thereby reducing the machining processes and the cost.

Preferably in particular, one end of the narrow passage created in the form of sinter-molded blank is connected to the small chamber and the other end is stopped just before the cylinder hole. Due to this configuration, it is possible to mold and manufacture a resonant chamber (small chamber and passage) by using a sintering die, thereby reducing the machining processes and the cost.

Preferably in particular, the discharge notch is formed by machining the cylinder block, and the narrow passage is formed in the form of sinter-molded blank. One end of the narrow passage is connected to the small chamber, and the other end of the narrow passage is connected to the discharge notch. With this configuration, it is possible to mold and manufacture a resonant chamber (small chamber and passage) by using a sintering die, thereby reducing the machining processes and the cost.

Preferably in particular, the narrow passage is formed in the sinter-molded blank. One end of the narrow passage is connected to the small chamber, and the other end of the narrow passage is connected to the discharge port formed in either the main bearing or the sub-bearing. By virtue of this configuration, it is possible to mold and manufacture a resonant chamber (small chamber and passage) by using a sintering die, thereby reducing the machining processes and the cost.

Preferably in particular, the small chamber and narrow passage are formed at the axial end of cylinder block in the form of sinter-molded blank. The narrow passage and small chamber formed at one end are closed by the bearing, and the small chamber formed at the other end is connected by a narrow passage to a point near the discharge port. With this configuration, it is possible to cope with both upward discharge type and downward discharge type by using a common cylinder block. In this way, the parts become usable in common resulting in cost reduction.

Preferably in particular, the small chamber and narrow passage are formed at the axial end of cylinder block in the form of sinter-molded blank. The narrow passage and small chamber formed at one end are closed by the bearing, and the small chamber formed at the other end is connected by a narrow passage to a point near the discharge port. With this configuration, it is possible to manufacture two cylinder blocks, upper and lower, by using common sinter-molded blanks, thereby making the parts usable in common and reducing the cost.

The compressor of still another embodiment of the present invention comprises a compression mechanism, motor, hermetically sealed housing, and intermediate plate. The compression mechanism includes compression elements, rotary shaft, main bearing and sub-bearing. The compression elements include a cylinder block, piston and vane. The cylinder block includes a cylinder hole and a vane groove diametrically connected thereto. The piston eccentrically rotates in the cylinder. The vane moves reciprocally in the vane groove while being in contact with the piston. The rotary shaft has an eccentric portion to drive the piston with the phase shifted by 180 degrees. The main bearing and sub-bearing serve to close the end of cylinder hole and to bear the rotary shaft. Both of the compression mechanism and the motor are housed in the hermetically sealed housing. The cylinder block is made up of sintered iron. The compression mechanism is welded to the hermetically sealed housing in a region other than the cylinder block. The cylinder block comprises a first cylinder block and a second cylinder block. The intermediate plate is disposed between the first cylinder block and the second cylinder block. The first cylinder block and the second cylinder block include sinter-molded blanks identical in shape. The sinter-molded blank for cylinder blocks is provided with at least a cylinder hole and vane groove. There is provided a land having a flat area slightly recessed at the intersection between the cylinder hole and the cylinder block end and between the vane groove and the cylinder block end, and a slope extending therefrom. The land is of a size to be eliminated later during cylinder hole, vane groove, and end cutting or machining operation. Due to this configuration, the land will not remain at the corner of the compression space. Accordingly, there will be no excessive leakage of refrigerant, realizing a high-efficiency compressor.

Preferably in particular, the refrigerant used is hydrof lorocarbon (HFC), and the refrigerator oil used is less in miscibility as compared to HFC. With this configuration, a cylinder block having a large volume may be manufactured by sintering so that even when the machining oil remains in a cavity the refrigerant oil having a low-polarity molecular structure will dissolve in the machining oil, thereby preventing capillary tubes or the like from being clogged by the machining oil.

Preferably in particular, the refrigerator oil used is synthetic oil based on hard alkyl benzene. Due to this configuration, the refrigerator oil has a low-polarity molecular structure. Accordingly, a cylinder block having a large volume may be manufactured by sintering so that even when the machining oil remains in a cavity the refrigerant oil will dissolve in the machining oil, thereby preventing capillary tubes or the like from being clogged by the machining oil.

The entire configuration of the embodiment of the present invention will be described in the following with reference to the drawings.

Figure 2:
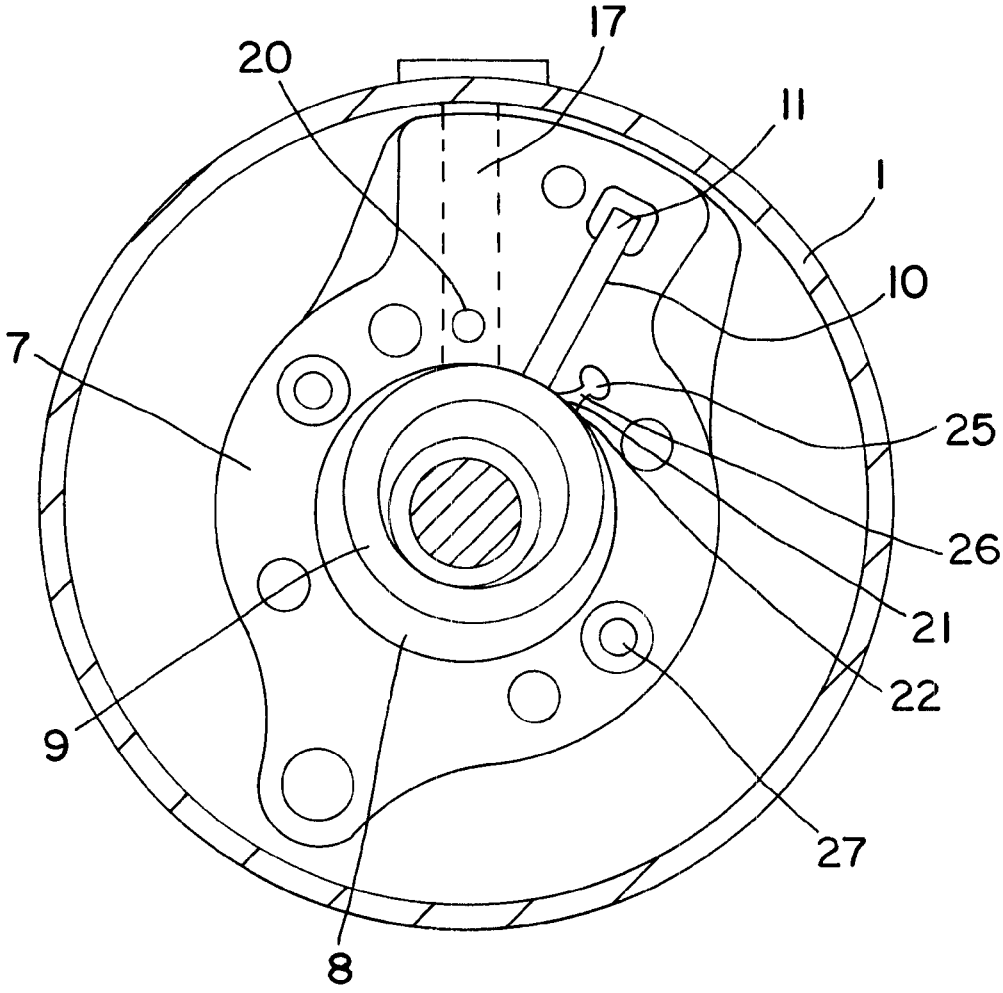
FIG. 2 is a traverse sectional view adjacent to the upper cylinder of the two-cylinder type rotary compressor of the embodiment in FIG. 1.

FIG. 1 is a longitudinal sectional view of a two-cylinder type rotary compressor of an embodiment of the present invention. FIG. 2 is a traverse sectional view near the cylinder. First, by using these figures, the basic structure and operation of the two-cylinder type rotary compressor of an embodiment of the present invention will be described.

In FIG. 1, motor unit 2 and compression mechanism 3 are housed in a hermetically sealed housing 1. The motor unit 2 comprises a stator 4 fixed inside the hermetically sealed housing 1 and a rotor 5 which rotates when a current flows in the stator 4. The rotor 5 is fixed to a rotary shaft 6.

The compression mechanism 3 comprises a first compression element 3*a* disposed at top and a second compression element 3*b* disposed at bottom. These compression elements 3*a*, 3*b*, as shown in the traverse sectional view of FIG. 2, include a cylinder block 7, a piston 9 being eccentric to cylinder hole 8 of the cylinder block 7, and a vane 11 which is inserted in vane groove 10 of the cylinder block 7 and reciprocally rotates while being in contact with piston 9.

The first compression element 3*a* and the second compression element 3*b*, partitioned by an intermediate plate 12, are independent of each other. The rotary shaft 6 goes through each of the compression elements 3*a*, 3*b*, and are provided with eccentric shafts 13*a*, 13*b*, with the phase shifted by 180 degrees from each other, at the portions corresponding to the first and second cylinder blocks 7*a*, 7*b* of compression elements 3*a*, 3*b*. The eccentric shafts 13*a*, 13*b* are engaged with the first and second pistons 9*a*, 9*b* arranged in the first and second cylinder holes 8*a*, 8*b* of cylinder blocks 7*a*, 7*b* respectively. The pistons 9*a*, 9*b* are eccentrically rotated by the eccentric shafts 13*a*, 13*b* respectively with the phase shifted by 180 degrees.

The rotary shaft 6 is rotatably supported at the sides by main bearing 14 on the motor unit 2 side and by sub-bearing 15 on the opposite side. The main bearing 14 serves to close the end of cylinder hole 8*a* of the first compression element 3*a* disposed at top. Similarly, the sub-bearing 15 serves to close the end of cylinder hole 8*b* of the second compression element 3*b* disposed at bottom. The main bearing 14 and sub-bearing 15 form a bearing.

The first and second cylinder blocks 7*a*, 7*b* are made up of sintered iron, and are integrally bolted by a set-bolt 16 that goes through the main bearing 14 and the sub-bearing 15 with the intermediate plate 12 therebetween. The compression mechanism 3, wherein the compression elements 3*a*, 3*b*, intermediate plate 12, rotary shaft 5, main bearing 14 and sub-bearing 15 are integrally secured by set-bolt 16, is spot-welded to the inner wall of hermetically sealed housing 1 at the outer periphery of main bearing 14 extending to the inner periphery of hermetically sealed housing 1. In many of conventional compressors, a cylinder block is spot-welded to the hermetically sealed housing. The cylinder block 7 of the present embodiment is made up of sintered alloy. Sintered alloy is impregnated with oil and the oil causes hindrance to welding. Accordingly, the compression mechanism 3 is secured by main bearing 14, and the material for main bearing 14 is cast iron.

The first cylinder block 7*a* disposed at top is provided with an intake port 17 with a hole that diametrically goes through from the side of cylinder block 7*a* toward cylinder hole 8*a*. The intake port 17 is communicated with outside the hermetically sealed housing 1 by intake liner 18 and intake pipe 19, serving as an intake gas inlet port of the compressor.

A part of the intake gas entering from the intake port 17 is taken into the cylinder hole 8*a* at top to be compressed as it is. On the other hand, the intake passage leading to the second cylinder block 7*b* at bottom has an axial through-hole (connecting hole) 20*a*, intersected by intake port 17, at the cylinder block 7*a*. The intake passage is connected to a slanted notch 20*b* that is in communication with cylinder hole 8*b* made in cylinder block 7*b* from a hole 20*c* made at the corresponding position of intermediate plate 12. (In the present invention, there are several embodiments related to intake passages, and the detailed description of the operation and advantages regarding intake passages will be given together in the relevant section.) Notch 20*b* extends up to the center of cylinder block 7*b*, from which the intake gas enters into cylinder hole 8*b* to be compressed therein.

The refrigerant gas compressed in cylinder hole 8*a*, 8*b* passes through discharge notch 21 at the opposite side with intake port 17 and vane 11 therebetween and is discharged to discharge muffler 24*a*, 24*b* from discharge port 22 of main bearing 14 and sub-bearing 15 through a discharge valve. Then, the gas compressed by the first compression element 3*a* is discharged upward, and the gas compressed by the second compression element 3*b* is discharged downward. Accordingly, the discharge notch 21 provided in cylinder block 7 is reversed in position in cylinder blocks 7*a*, 7*b* respectively.

Generally, discharge port 22 is disposed so as to overlap cylinder hole 8 by nearly half, and discharge notch 21 is a slanted notch made in cylinder block 7 that overlaps the discharge port 22. Discharge notch 21 is not formed sometimes depending upon the position of discharge port 22 and the volume of refrigerant circulated.

Further, a resonant chamber including a small chamber 25 and narrow passage 26 is formed by a sintering die at the end of cylinder block 7. The narrow passage 26 is in communication with discharge notch 21. The small chamber 25 at the end of cylinder block 7 is closed by main bearing 14 or sub-bearing 15, thereby having a specific volume. The chamber has a volume that is about 0.3% to 5% of the cylinder volume and functions to reduce the pressure pulsation generated in the cylinder, bringing about an effect to realize a low-noise compressor. When there is no discharge notch 21, one end of the narrow passage 26 opens to the discharge port.

The refrigerant gas discharged into the discharge muffler 24*b* at bottom goes into the discharge muffler 24*a* through discharge connection hole 27 made in cylinder block 7, and joins the refrigerant gas compressed by cylinder block 7*a*. After that, the refrigerant gas is discharged into the closed container. The gas serves to cool the motor 2 and is discharged from discharge pipe 28 at top of the closed container 1.

Exemplary Embodiments of the present invention will be described in the following.

Exemplary embodiment 1

Figure 3:
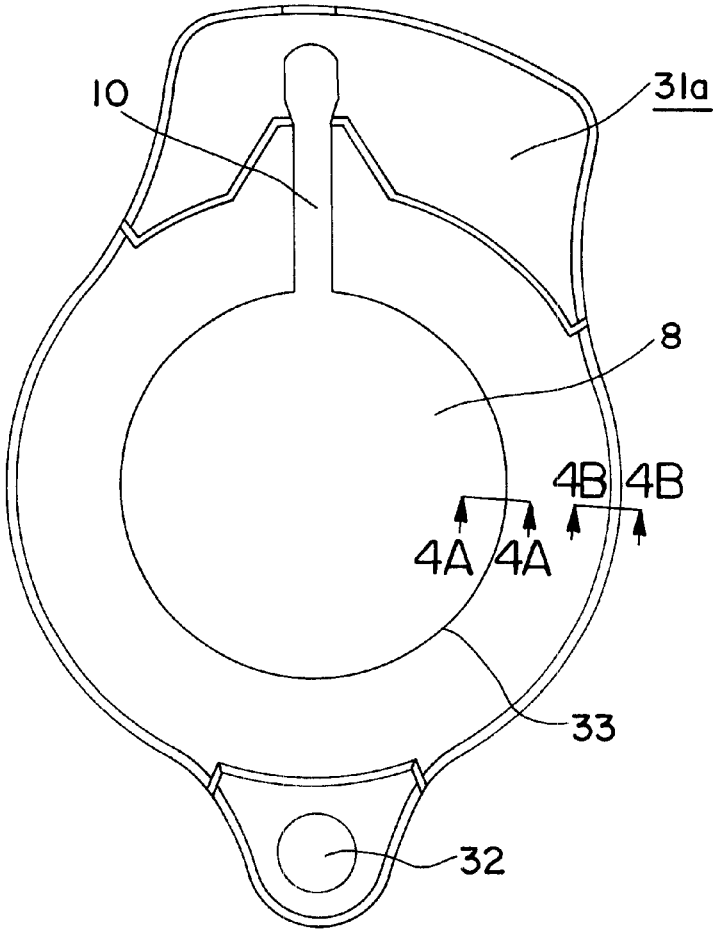
FIG. 3 is a diagram showing the sinter-molded blank for cylinder blocks of the first embodiment of the present invention.

FIG. 3 is a traverse sectional view of sinter-molded blank 31*a* for cylinder block 7 in the first embodiment. The sinter-molded blank 31*a* has a cylinder hole 8 formed nearly at the center of same and a vane groove 10 diametrically formed leading to the cylinder hole 8. Also, a work-reference hole 32 is formed in a direction opposite to vane groove 10. The material for sinter-molded blank 31*a* is iron-based sintered metal. Iron-based alloy powder is put into a die having a shape as shown in FIG. 3 and is axially pressed (at right angles to the sheet of paper), and then hardened. The sinter-molded blank 31*a* is manufactured in this way.

Figure 4A:
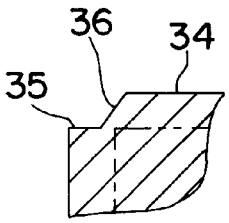
FIG. 4(A) and FIG. 4(B) are enlarged sectional views of the land shape portions in FIG. 3.
Figure 4B:
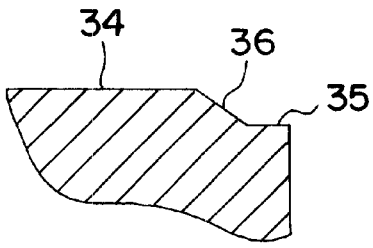

In order to completely press the powder, there is provided a small step called land 33 as shown in FIG. 3 at the outer periphery of the sinter-molded blank 31*a*. FIG. 4(A) is a cross-sectional view of 4A–4A line in FIG. 3, and FIG. 4(B) shows a cross-sectional view of 4B–4B line in FIG. 3. As shown in FIG. 4(A) and FIG. 4(B), the outermost periphery of land 33 has a flat area 35 slightly recessed as against end 34, and the flat area 35 and the end 34 are connected by a slope 36 with each other. The land shape at the outer periphery of cylinder block 7 is relatively large, and the land shape at cylinder hole 8 and vane groove 10 is rather smaller.

In order to secure air-tightness after calcination of sinter-molded blank 31*a*, steam treatment is performed on the sinter-molded blank 31*a*. After that, the sinter-molded blank 31*a* of the present embodiment is finished by machining with respect to the bore of cylinder hole 8, vane groove 10 and end 34.

Sinter-molded blank 31*a* is finished with dimensional accuracy of about 0.2 mm, and as compared with a cast iron blank, it requires no rough finishing and less cutting margin, thereby reducing the machining cost. Also, in a two-cylinder type rotary compressor, although two cylinder blocks 7*a* and 7*b* are different in shape from each other, as described above, the sinter-molded blank 31*a* comprises vane groove 10 and cylinder hole 8 as basal portions, thereby making the die usable in common and improving the productivity.

Preferably, the size of the cutting margin for cylinder hole 8 and vane groove 10, as shown by chain double-dotted line in FIG. 4(A) is as large as possible provided that the land is not eliminated. Since this portion serves as a seal at the corner for high and low pressures, it is preferable that the land is not allowed to remain. However, if the cutting margin is large in size, it will result in higher material and machining costs. Accordingly, it is preferred to make the outer land larger than the inner land (at cylinder hole, vane groove), keeping the die well balanced with respect to its life, and then to minimize the inner land shape.

Exemplary Embodiment 2

Figure 5:
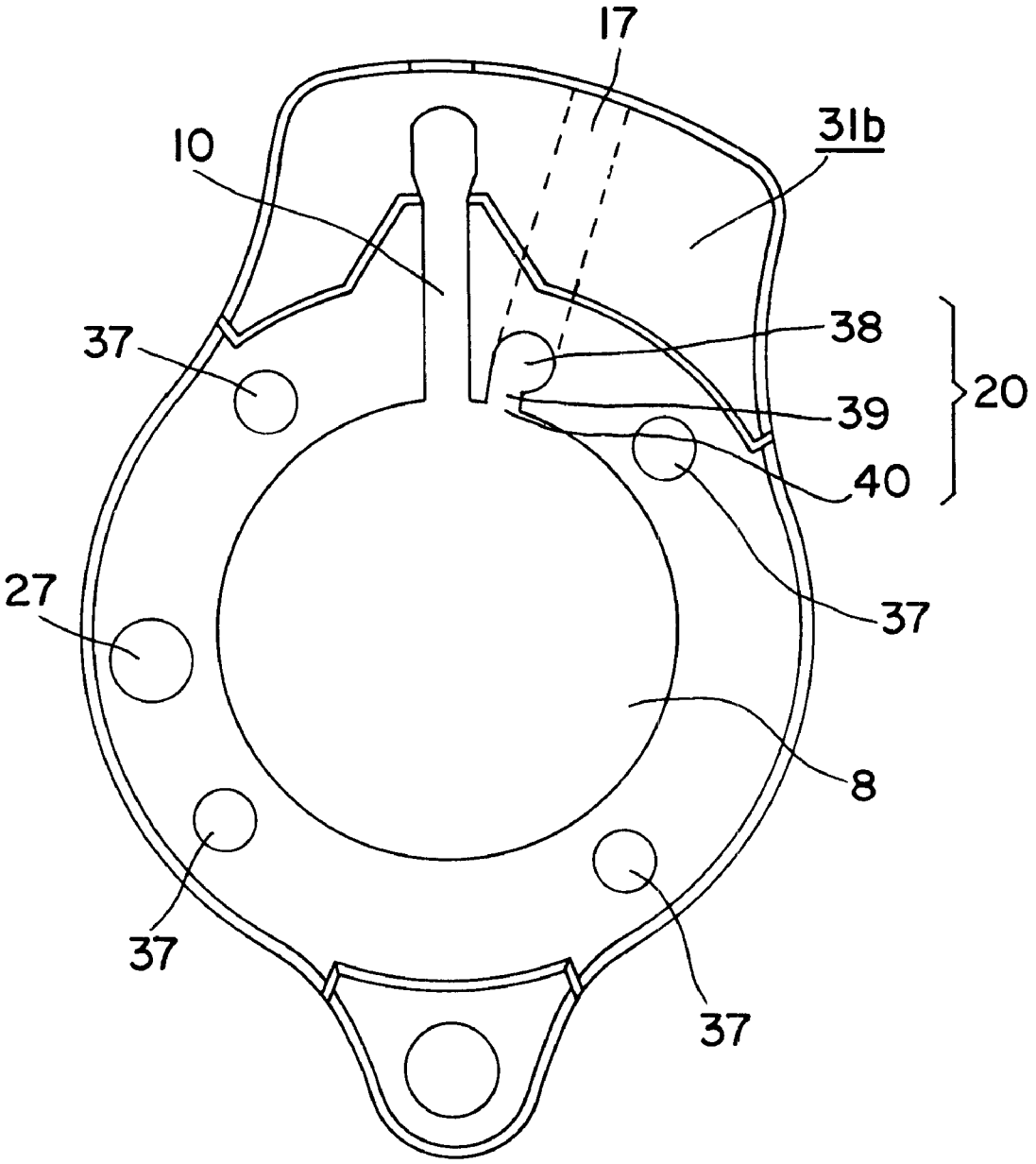
FIG. 5 is a diagram showing the sinter-molded blank for cylinder blocks of the second embodiment of the present invention.

FIG. 5 shows the sinter-molded blank 31*b* for cylinder block 7 in the second embodiment of the present invention. As compared with the embodiment shown in FIG. 3, mounting holes 37 and discharge connection hole 27 are formed in sinter-molded blank 31*b*. To make common the mounting holes 37 at top and bottom of a two-cylinder type rotary compressor, using a configuration such that mounting bolt 16 goes through two cylinder blocks 7*a*, 7*b*, and main bearing 14 or sub-bearing 15 has a tap is a simplest and cost-saving method. However, a long bolt is poor in workability. Accordingly, tapping holes are formed in sinter-molded blank 31*b* and are tapped in cylinder blocks 7*a*, 7*b* during assembling. This will improve the workability.

Further, in the present embodiment, sinter-molded blank 31*b* includes an intake passage 20. The intake passage 20 comprises a through-hole 38 in axially parallel with cylinder hole 8, a connecting passage 39 leading to the through-hole 38 while opening to the cylinder hole 8, and an opening 40 that is less in diameter than through-hole 38 and is opening toward vane groove 10 from the center of through-hole 38. All of these axially go through. Accordingly, it is possible to perform powder molding for sinter-molded blank 31*b*. At the same time, securing a sufficient passage area, the opening is positioned at the vane side in order to improve the volume efficiency.

Figure 6:
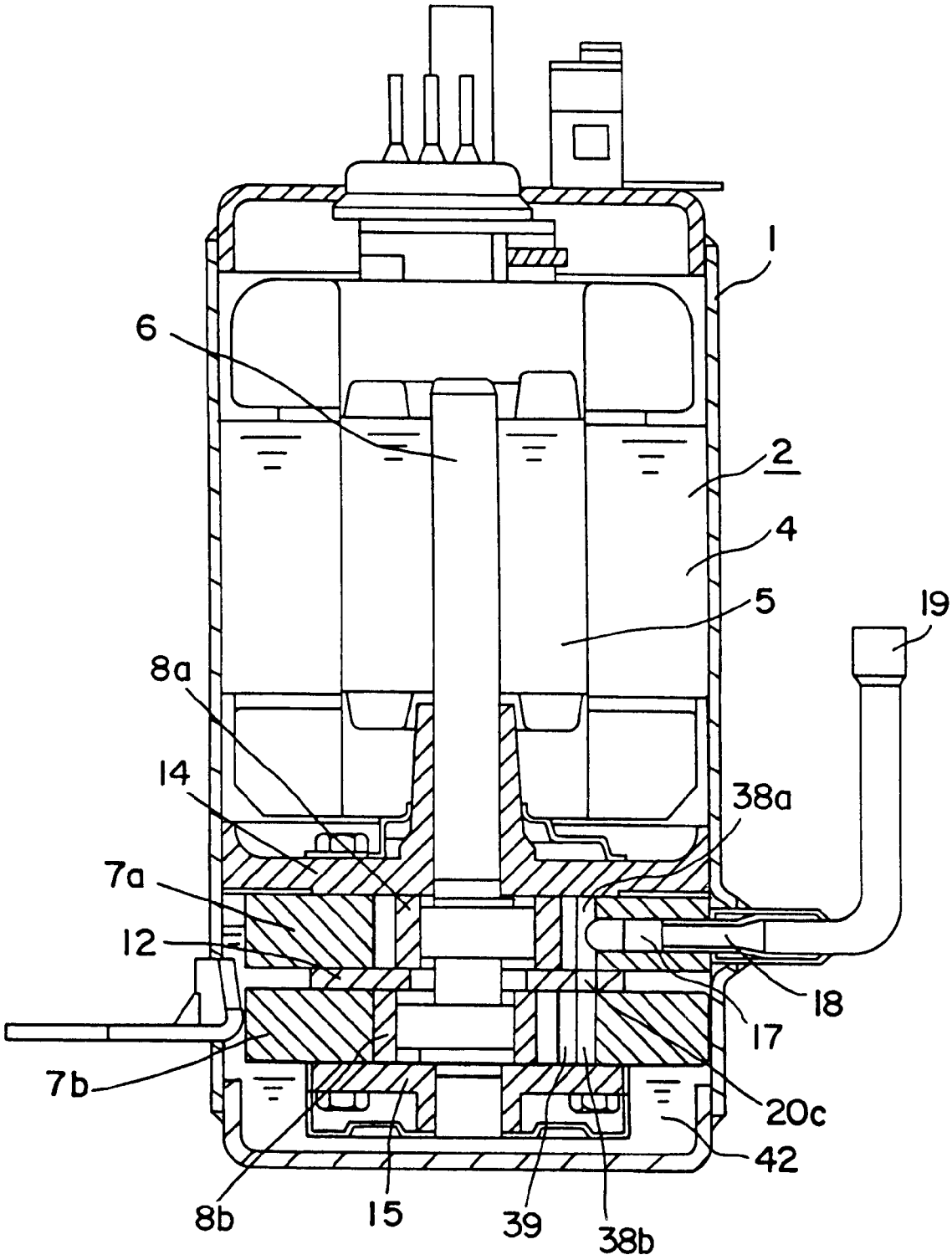
FIG. 6 is a longitudinal sectional view of the two-cylinder type rotary compressor using the sinter-molded blank of the second embodiment of the present invention.

FIG. 6 is a longitudinal sectional view of a two-cylinder type rotary compressor manufactured by using sinter-molded blank 31*b*. A hole 20*c* is formed in intermediate plate 12 at the position corresponding to through-hole 38. In this way, the sinter-molded blank 31*b* for first and second cylinder blocks 7*a*, 7*b* is usable in common, improving the productivity. Since sinter-molded blank 31*b* is used in common for cylinder blocks 7*a*, 7*b*, intake port 17 that takes in refrigerant gas from outside hermetically sealed housing 1 is formed in cylinder block 7*a*. In this case, a hole is made from outside the cylinder block 7*a* by machining toward through-hole 38, thereby forming intake port 17. Here, the intake port 17 may go through to the cylinder hole 8*a*. Also, when the intake port 17 is stopped at the axial through-hole 38, the volume efficiency will further become higher.

Exemplary Embodiment 3

Figure 7:
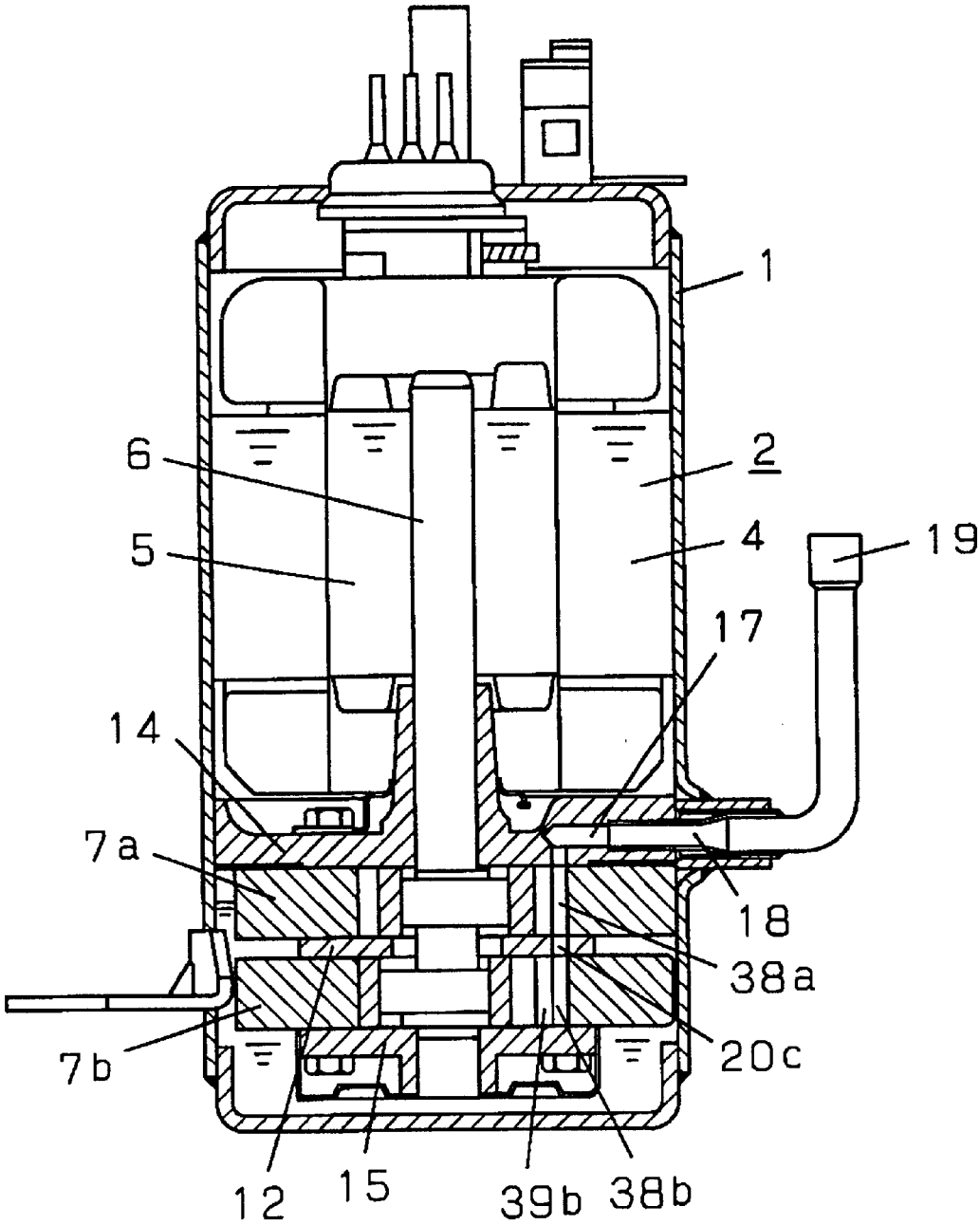
FIG. 7 is a longitudinal sectional view of the two-cylinder type rotary compressor of the third embodiment of the present invention.

FIG. 7 is a longitudinal sectional view of the two-cylinder type rotary compressor in the third embodiment of the present invention. As shown in FIG. 7, in the two-cylinder type rotary compressor, intake port 17 that takes in refrigerant gas from outside the hermetically sealed housing 1 is made in main bearing 14, and the intake gas is branched therefrom. Thus, cylinder block 7 in the form of completely finished molding as well as sinter-molded blank 31*b* are usable in common. Further, it is possible to provide a compressor excellent in productivity. Similar effects will be obtained when intake port 17 is created in sub-bearing 15 and intermediate plate 12 as well as in main bearing 14. When intake port 17 is formed in sub-bearing 15, it is preferred to employ a configuration of a horizontal type compressor.

Exemplary Embodiment 4

Figure 8:
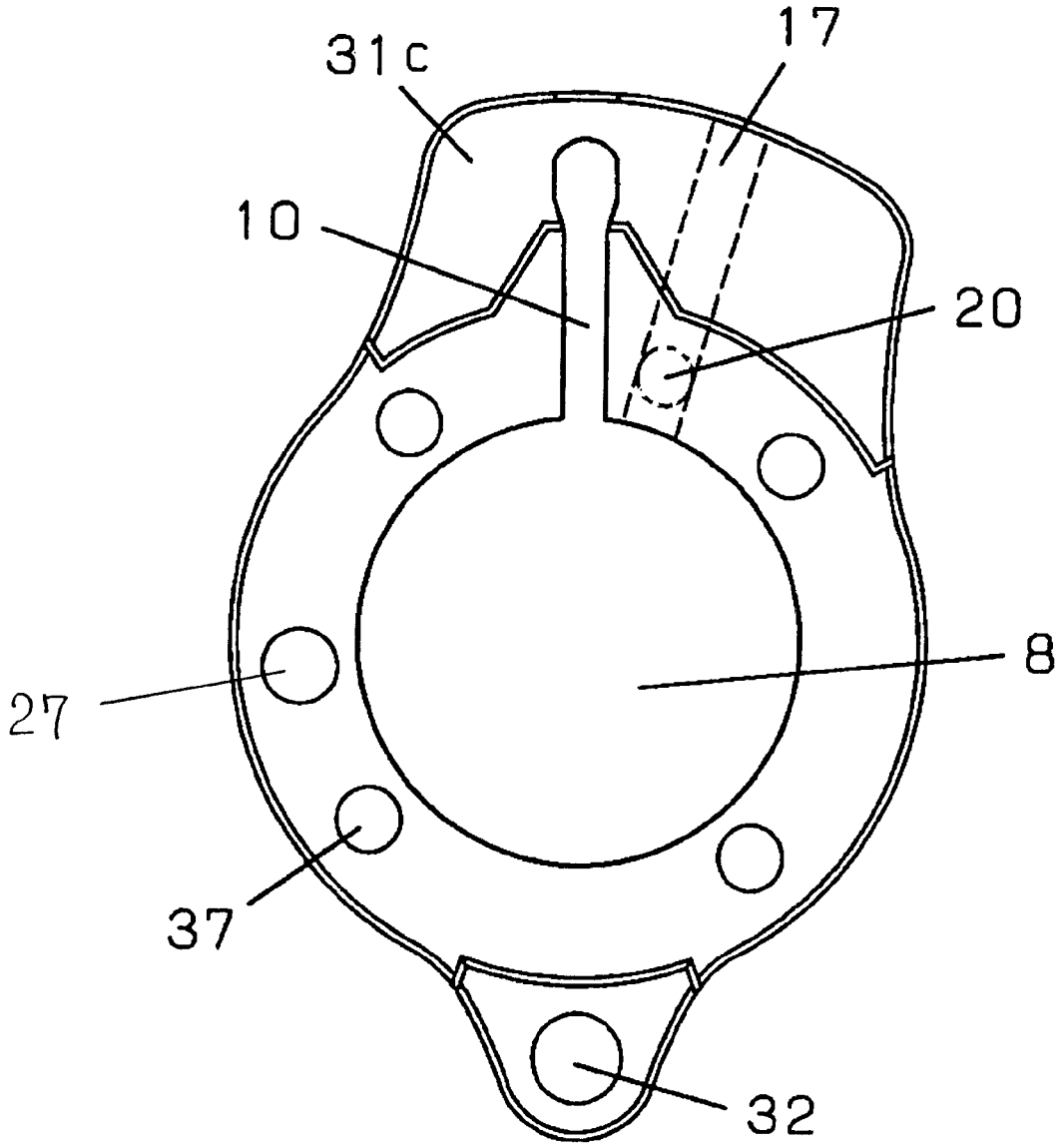
FIG. 8 is a diagram showing the sinter-molded blank for cylinder blocks of the fourth embodiment of the present invention.

FIG. 8 shown the sinter-molded blank 31*c* of cylinder block 7 in the fourth embodiment of the present invention, which has another type of an intake passage. The longitudinal sectional view of the two-cylinder type rotary compressor of the embodiment using the sinter-molded blank 31*c* is shown in FIG. 1. Therefore, only the difference from FIG. 5 is described here. The sinter-molded blank 31*c* of FIG. 8 is used as the first cylinder block 7*a* at top of FIG. 1. In the sinter-molded blank 31*c* are formed a cylinder hole 8, vane groove 10, mounting hole 37, reference hole 32 and discharge connection hole 27 as shown by solid lines. The axial through-hole of intake passage 20 and intake hole 17 shown by dotted lines are made by machining. Thus, the cylinder block 7*a* is formed. In the configuration of the intake passage shown in FIG. 1, the intake passages of cylinder block 7*a* and cylinder block 7*b* are different in shape. However, the cylinder blocks 7*a*, 7*b* of the present embodiment are formed by sinter-molded blanks with respect to common parts only. It will therefore result in productivity improvement.

On the other hand, as described in FIG. 1, the intake port of cylinder block 7*b* at bottom has a slanted notch 20*b*. The notch 20*b* extends to the center of cylinder block 7*b*, from which the intake gas enters the cylinder hole 8*b* and is compressed. Preferably, the notch 20*b* secures an appropriate opening area and is positioned shifting a little towards the vane. In this way, the volume efficiency will be improved. Accordingly, the notch 20*b* is preferable to be thinly elongated in the lengthwise direction. Also, it is preferable that the gas coming down is smoothly guided into cylinder hole 8. Due to this configuration, the fluid resistance will be decreased, preventing overheating of the intake gas and improving the volume efficiency. Combining these factors, there is formed a slanted notch that opens in the range from ⅓ to ⅔ of the axial length of cylinder 7*b* .

Also, machining is difficult to perform for slanted notch 20*b* because it is necessary to change the direction of the work to be machined. To form the notch 20*b* in a state of sinter-molded blank, sacrificing the commonness of the blank for cylinder blocks 7*a*, 7*b*, it is required that the intersection between the notch and the cylinder 8, notch bottom 41 shown in FIG. 1, be in the range from 75 degrees to 90 degrees. Thus, it is possible to apply pressures to the powder during pressing and to prevent the reduction in density of the molding.

Exemplary Embodiment 5

Figure 9:
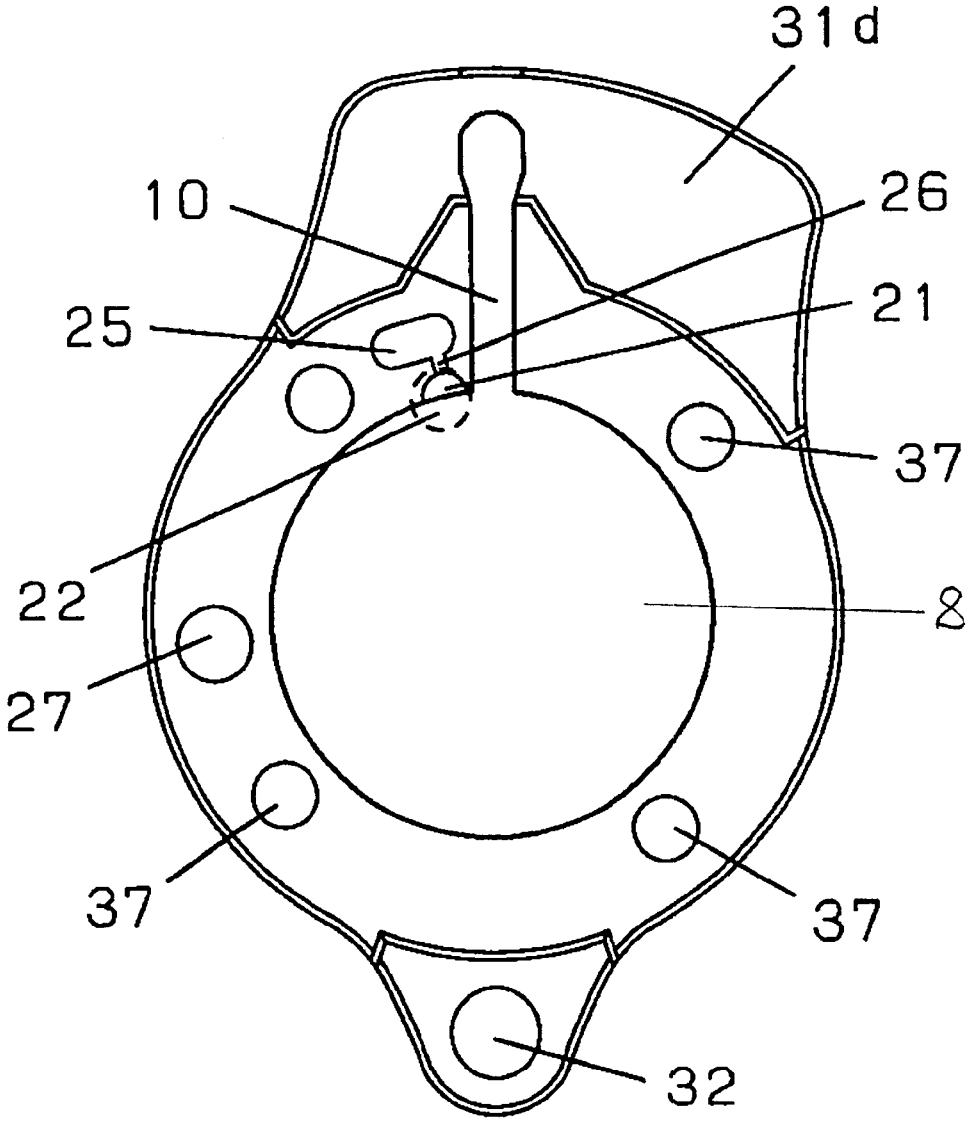
FIG. 9 is a diagram showing the sinter-molded blank for cylinder blocks of the fifth embodiment of the present invention.

FIG. 9 shows the sinter-molded blank 31*c* of cylinder block 7 in the fifth embodiment of the present invention. The periphery of the discharge port of cylinder block 7 in the present embodiment is described in the following. The sinter-molded blank 31*d* shown by solid lines, same as in other embodiments, comprises cylinder hole 8, vane groove 10, mounting hole 37, reference hole 32, and discharge connection hole 27. The circle shown by broken lines at the left side of vane groove 10 is the position of discharge hole 22 provided in main bearing 14 or sub-bearing 15. The semi-circular portion of the circle at the cylinder block side is the passage of discharge gas, which is a discharge notch 21 created aslant in the cylinder block 7. As is described in FIG. 1, upper and lower cylinder blocks 7*a*, 7*b* are different in discharge direction. Accordingly, the notch 21 is not formed in sinter-molded blank 31*d* but formed later by machining. The cylinder blocks 7*a*, 7*b* are formed in this way.

At the end of cylinder block 7 near the notch 21 is formed a resonant chamber including a small chamber 25 and narrow passage 26 by means of a sintering die, which is relatively shallow in shape. The narrow passage 25 is in communication with discharge notch 21. The small chamber 25 at the end of cylinder block 7 is closed by main bearing 14 or sub-bearing 15, forming a chamber having a specific volume. The volume of the chamber ranges from about 0.3% to 5% of the cylinder volume and serves to reduce the pressure pulsation generated in the cylinder, effectively realizing a low-noise compressor.

Also, it is possible to form narrow passage 26 by machining. The narrow passage 26 includes a die-forming process so as to stop just before cylinder hole 8 and a notch 21 forming process by machining to connect them with each other. That is, a resonant chamber having a small chamber 25 and narrow passage 26 is previously formed by a sintering die at the sides of the cylinder block, and later only the notch to be used is made at one side to provide communication with the resonant chamber. The other side is closed by the bearing, creating a closed space. Accordingly, when the gas is discharged upward and also when it is discharged downward, the sinter-molded blank 31*d* for cylinder block 7 may be used in common, thereby making it possible to obtain a compressor of high production efficiency.

Further, with this configuration, upper and lower cylinder blocks in the case of a two-piston compressor may be used in common, and even in the case of a single-piston compressor, it is possible to use in common the parts for upward discharge type and downward discharge type compressors.

Exemplary Embodiment 6

Figure 10:
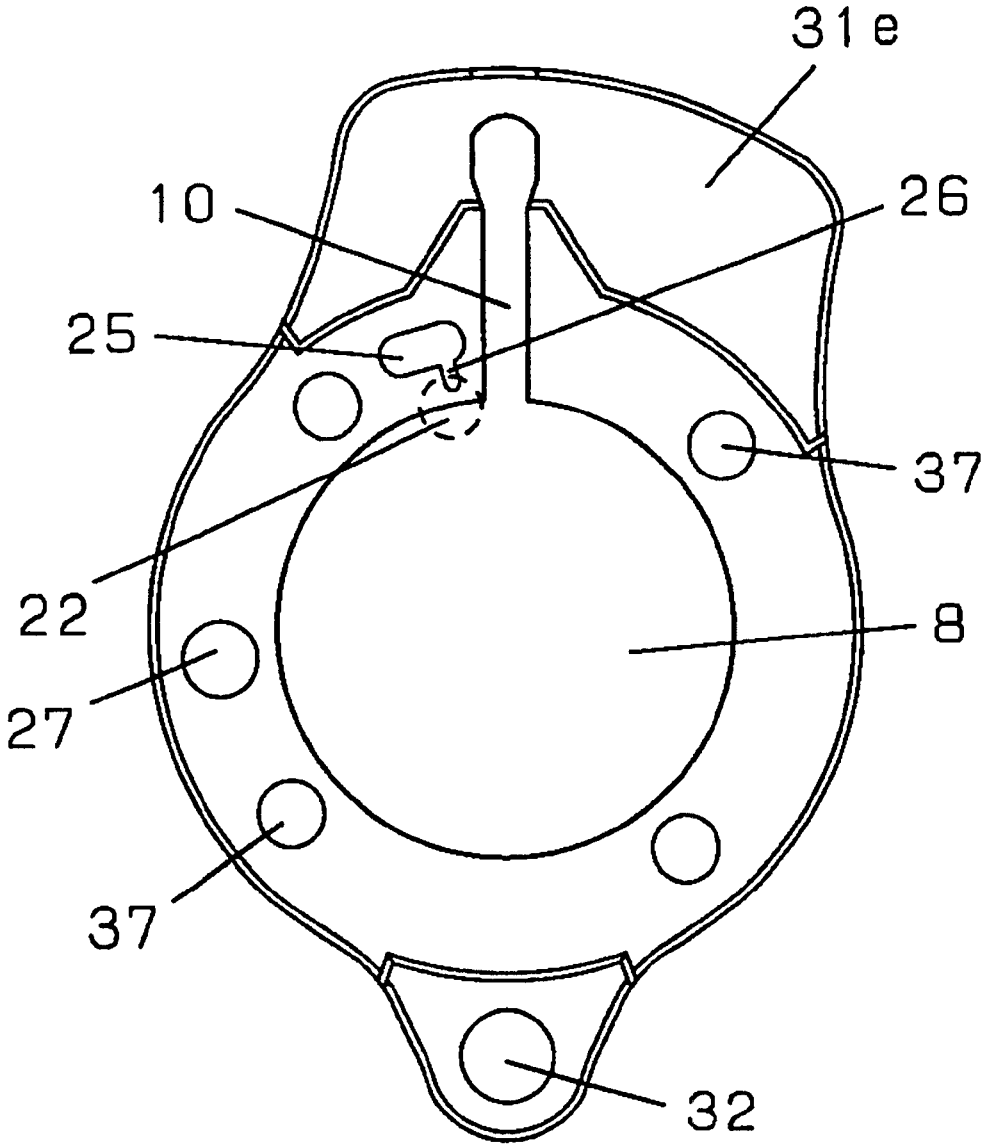
FIG. 10 is a diagram showing the sinter-molded blank for cylinder blocks of the sixth embodiment of the present invention.
Figure 11:
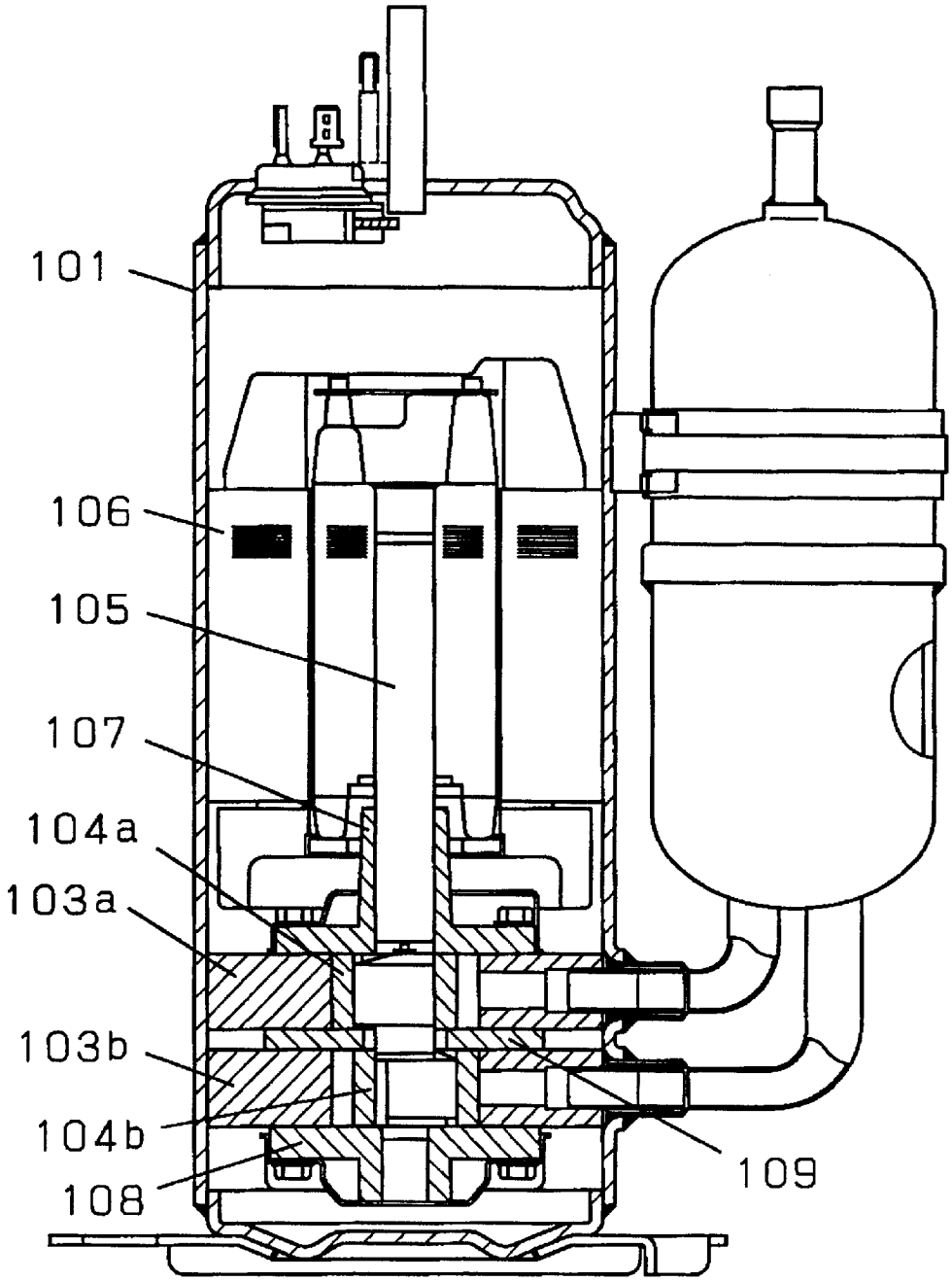
Fig. 11 PRIOR ART
FIG. 11 is a longitudinal sectional view of a conventional two-cylinder type rotary compressor.

FIG. 10 shows the sinter-molded blank 31*e* for cylinder block 7 in the sixth embodiment of the present invention. As compared with the embodiment shown in FIG. 9, discharge notch 21 is not formed in this embodiment. Only the difference from the embodiment of FIG. 9 is described here. In FIG. 10, the same as in FIG. 9, the circle shown by broken lines is the position of discharge port 22 provided in main bearing 14 or sub-bearing 15. At the end of cylinder block 7 near the discharge port 22 is formed a resonant chamber having a small chamber 25 and narrow passage 26 by means of a sintering die, which is relatively shallow in shape. The narrow passage extending from the small chamber is die-formed so as to stop just before cylinder hole 8, and the passage is in communication with discharge port 22 shown by broken lines. The difference between FIG. 10 and FIG. 9 is that FIG. 10 does not include notch 21. Since discharge port 22 is located at the sidewise position of cylinder hole 8, when the compressor is lower in capacity (less in volume of the flowing refrigerant gas), there will be no excessive flow resistance even in case no discharge notch is formed.

In the case of such compressor, the same as described in FIG. 9, only required is to previously form a resonant chamber having a small chamber 25 and narrow passage 26 by a sintering die at the sides of cylinder block 7. Only discharge notch 22 to be used is made at one side to provide communication with the resonant chamber, and the other side is closed by the bearing, creating a closed space. Accordingly, when the gas is discharged upward and also when it is discharged downward, the cylinder block 7 may be used in common, thereby obtaining a compressor that ensures excellent production efficiency.

Further, with this configuration, upper and lower cylinder blocks in the case of a two-piston compressor may be used in common, and even in the case of a single-piston compressor, it is possible to use in common the parts for upward discharge type and downward discharge type compressors.

The present embodiment imposes no special limitations upon the refrigerant and refrigerator oil 42 used. For example, the refrigerant used is hydroflorocarbon (HFC). The refrigerator oil 42 used is of a low-polarity molecular structure. In use of such material, when a cylinder having a large volume is manufactured by sintering and the machining oil remains in a cavity, the refrigerator oil 42 with a low-polarity molecular structure will dissolve in the machining oil. Accordingly, clogging trouble of capillary tubes or the like will be prevented.

For example, refrigerator oil 42 used is a synthetic oil based on hard alkyl benzene. In this case, the refrigerator oil 42 has a low-polarity molecular structure. Therefore, when a cylinder block having a large volume is manufactured by sintering and the machining oil remain in a cavity, the refrigerator oil 42 will dissolve in the machining oil. Accordingly, clogging trouble of capillary tubes or the like will be prevented.

As described above, the configuration of the present invention will bring about the following advantages.

It is possible to realize the reduction of the machining processes as well as the cost in the manufacture of a rotary compressor. Due to a configuration such that the compression mechanism and hermetically sealed housing are secured by members other than cylinder blocks, it is possible to use hard-to-weld sintered iron for cylinder blocks, and as a result, the machining processes and the cost will be reduced. It becomes possible to use a common die for the manufacture of two cylinder blocks, thereby reducing the cost. The volume efficiency may be improved by the intake passage of the present invention. The noise will be reduced since there is provided a small chamber as a resonant chamber. Due to a configuration such that no land remains at the corner where a combustion space is formed, leakage of the refrigerant may be prevented, obtaining a high-efficiency compressor. Also in a configuration wherein cylinder blocks are manufactured by sintering, it is possible to prevent capillary tubes from being clogged by refrigerator oil or machining oil.

What is claimed is:

1. A rotary compressor comprising:

(a) a compression mechanism including compression elements, a rotary shaft, a main bearing, and a sub-bearing;

in which said compression elements include a cylinder block, a piston and a vane, said cylinder block includes a cylinder hole and a vane groove, said vane groove is diametrically connected to said cylinder hole, said piston eccentrically rotates in said cylinder hole, said vane reciprocally moves in said vane groove while being in contact with said piston, said rotary shaft includes an eccentric portion to drive said piston with the phase shifted by 180 degrees, and said main bearing and said sub-bearing serve to close the end of said cylinder hole and to bear said rotary shaft;

(b) a motor; and (c) a hermetically sealed housing in which said compression mechanism and said motor are housed, wherein said cylinder block is made of sintered metal, said cylinder block being machined from a sinter-molded blank, said sinter-molded blank including a land, and at least said cylinder hole and said vane groove, and said land at an intersection of said cylinder hole and a cylinder block end, and at an intersection of said vane groove and said cylinder block end.

2. The rotary compressor of claim 1, wherein said compression mechanism has a discharge port to discharge compressed refrigerant, said discharge port includes a first discharge port formed in said main bearing and a second discharge port formed in said sub-bearing, said discharge port is a machined hole formed by machining, said discharge port overlaps the inside and the outside of said cylinder hole as viewed axially, and said cylinder block positioned just outside said discharge port has a slanted notch.

3. The rotary compressor of claim 1, wherein said compression mechanism is welded to at least one of said main bearing, said intermediate plate and said sub-bearing.

4. The rotary compressor of claim 1, wherein said sinter-molded blank for said cylinder block further includes a mounting hole formed therein.

5. The rotary compressor of claim 1, wherein said sinter-molded blank for said cylinder block further includes an intake passage formed therein.

6. The rotary compressor of claim 1, wherein said compression mechanism includes refrigerant and refrigerator oil, said refrigerant contains hydroflorocarbon, and said refrigerator oil is less miscible as against hydroflorocarbon.

7. The rotary compressor of claim 6, wherein said refrigerator oil includes a synthetic oil based on hard alkyl benzene.

8. The rotary compressor of claim 1, wherein said compression mechanism further includes an intermediate plate, said cylinder block includes a first cylinder block and a second cylinder block, said intermediate plate is disposed between said first cylinder block and said second cylinder block, and said first cylinder block and said second cylinder block are formed by machining sinter-molded blanks identical in shape.

9. The rotary compressor of claim 8, wherein said cylinder block further includes a small chamber and narrow passage, both of said small chamber and said narrow passage are formed at the axial end of said cylinder block, and said small chamber includes a first end closed by said bearing and a second end connected to said narrow passage near said discharge port.

10. The rotary compressor of claim 8, wherein said sinter-molded blank for said cylinder block has said cylinder hole and said vane groove formed therein.

11. The rotary compressor of claim 10, wherein said sinter-molded blank for said cylinder block further includes a mounting hole formed therein.

12. The rotary compressor of claim 10, wherein said sinter-molded blank for said cylinder block further includes an intake passage formed therein.

13. The rotary compressor of claim 12, wherein said intake passage includes a through-hole that axially goes through in parallel with said cylinder hole, a connecting passage leading to said through-hole and opening to said cylinder hole, an opening that opens to a position at the side of said vane groove from the center of said through-hole; and said opening is less in width than the diameter of said through-hole.

14. The rotary compressor of claim 13, wherein said compression mechanism has an intake port, said intake port takes in refrigerant gas from outside said hermetically sealed housing, said intake port is formed in at least one selected from the group consisting of said main bearing, said intermediate plate and said sub-bearing.

15. The rotary compressor of claim 14, wherein said first cylinder block and said second cylinder block are identical in shape with each other.

16. The rotary compressor of claim 13, wherein at least one of said first cylinder block and said second cylinder block has an intake port that takes in refrigerant gas from outside said closed container.

17. The rotary compressor of claim 16, wherein said intake port has a hole that goes through in a direction diametrical to said cylinder hole, and said hole is a machined hole made by machining said sinter-molded blank for said cylinder block from outside said cylinder block.

18. The rotary compressor of claim 16, wherein said intake port has a hole formed in said sinter-molded blank for said cylinder block, said hole is a machined hole formed by machining, and said hole of said intake port is connected to said through-hole of said intake passage from outside said cylinder block and is not connected to said cylinder hole.

19. The rotary compressor of claim 8, wherein at least one of said first cylinder block and said second cylinder block has an intake port, said intake port has a through-hole that goes through in a direction diametrical to said cylinder hole, said intake port is made by machining from outside said cylinder block, said through-hole is formed axially to intersect said intake port, said intermediate plate has a connecting hole that is connected to said through-hole, said intake port has a slanted notch, and said notch is formed so as to be connected to said intake port of said cylinder block via said through-hole.

20. The rotary compressor of claim 19, wherein said slanted notch is connected to said intake port of the other cylinder block via said through-hole, and said slanted notch is formed in the range from ⅓ to ⅔ of the axial length of said cylinder block.

21. The rotary compressor of claim 20, wherein the intersection between said slanted notch and said cylinder hole is in the range from 75 degrees to 90 degrees.

22. A rotary compressor comprising:

(a) a compression mechanism including compression elements, a rotary shaft, a main bearing, and a sub-bearing;

in which said compression elements include a cylinder block, a piston and a vane, said cylinder block has a cylinder hole and a vane groove, said vane groove is diametrically connected to said cylinder hole, said piston eccentrically rotates in said cylinder hole, said vane reciprocally moves in said vane groove while being in contact with said piston, said rotary shaft has an eccentric portion to drive said piston with the phase shifted by 180 degrees, said main bearing and said sub-bearing close the end of said cylinder hole and serve to bear said rotary shaft;

(b) a motor; and (c) a hermetically sealed housing in which said compression mechanism and said motor are housed, wherein said cylinder block is made of sintered iron, said compression mechanism is welded to said hermetically sealed housing at said main bearing, said cylinder block is formed by machining a sinter-molded blank, said sinter-molded blank includes a land, at least said cylinder hole and said vane groove, said land includes a flat area and a slope that connects to said flat area, said flat area is formed so as to be slightly recessed at the intersection between said cylinder hole and said cylinder block end and between said vane groove and said cylinder block end, and said land has a size to be later eliminated during said cylinder hole, said vane groove and end cutting and machining operation.

* * * * *